US005793929A

United States Patent [19]

Taylor

[11] Patent Number: 5,793,929

[45] Date of Patent: Aug. 11, 1998

[54] IMMERSION HEATERS WITH HEATING ELEMENTS IN THE FORM OF PRINTED CIRCUIT TRACKS

[75] Inventor: John Crawshaw Taylor, Arbory, Isle of Man

[73] Assignee: Strix Limited, Ronaldsway, Isle of Man

[21] Appl. No.: 501,068

[22] PCT Filed: Feb. 14, 1994

[86] PCT No.: PCT/GB94/00300

§ 371 Date: Oct. 11, 1995

§ 102(e) Date: Oct. 11, 1995

[87] PCT Pub. No.: WO94/18807

PCT Pub. Date: Aug. 18, 1994

[30] Foreign Application Priority Data

Feb. 15, 1993 [GB] United Kingdom ..... 9302965

[51] Int. Cl.[6] ..... H05B 1/02

[52] U.S. Cl. ..... 392/498; 392/501; 219/457; 219/543

[58] Field of Search ..... 392/498, 501, 392/451, 453, 455, 485; 219/457, 458, 459, 540, 544, 546, 552, 553, 451, 523, 538, 541, 543

[56] References Cited

U.S. PATENT DOCUMENTS

| | | | |
|---|---|---|---|
| 4,621,186 | 11/1986 | Taylor et al. | 392/498 |
| 4,859,835 | 8/1989 | Balderson | 219/552 |
| 5,278,941 | 1/1994 | Ward | 392/498 |

FOREIGN PATENT DOCUMENTS

| | | |
|---|---|---|
| 206 046 | 12/1986 | European Pat. Off. . |
| 352 499 | 1/1990 | European Pat. Off. . |
| 2 153 190 | 8/1985 | United Kingdom . |
| 2 181 598 | 4/1987 | United Kingdom . |
| 2 222 025 | 2/1990 | United Kingdom . |

*Primary Examiner*—Tu B. Hoang

*Attorney, Agent, or Firm*—Burns, Doane, Swecker & Mathis, L.L.P.

[57] ABSTRACT

An immersion heater has a support plate on which there is provided an electrical heating element in the form of a printed circuit conductive track. The element is provided with a portion which allows it to be clamped in direct relation to a control unit in order to provide direct electrical, thermal, and mechanical connection to that unit. This allows the control unit to operate in the same manner as a control unit connected to a conventional immersion heater. A water heating vessel using the immersion heater mounted to a control unit through an aperture in the base of the vessel is also disclosed.

20 Claims, 4 Drawing Sheets

IMMERSION HEATERS WITH HEATING ELEMENTS IN THE FORM OF PRINTED CIRCUIT TRACKS

FIELD OF THE INVENTION

This invention relates to electric immersion heaters.

BACKGROUND AND SUMMARY OF THE INVENTION

Electric immersion heaters are very widely used in water heating electric appliances such as kettles, hot water jugs, washing machines, dish washers, urns etc. The standard form of immersion heater comprises an elongate metal sheathed element which is formed into a tortuous configuration to provide the required length of element within the size constraints of the water heating vessel. It is traditional that the element terminates in so-called cold leads by means of which electric connections are made to the heater. There is also generally provided an intermediate "hot return" portion which in use is in thermal contact with a thermally sensitive actuator of a control device which incorporates a switch for disabling the heater in the event of it overheating in consequence of there being insufficient water in the vessel to cover the element.

Such immersion heaters are used as standard in most electric kettles and hot water jugs. They are traditionally located in the lower part of such a vessel so that a minimum amount of water can be boiled. Since an immersion heater is substantially surrounded by water, heat generated from all sides of the heating element is dissipated which renders an immersion heater more efficient than heaters which are mounted externally of the water containing vessel and which heat the water via a vessel wall. This latter form of heater is less efficient in that heat dissipated from the side of the heating element remote from the vessel wall is essentially wasted. Such heaters are generally run at a higher temperature than immersion heaters and therefore more prone to failure.

Known immersion heaters do have certain drawbacks. In particular, they are, to an extent, aesthetically unpleasing. This is particularly so when they become covered in scale as is inevitable in the longer term. The shape of known heating elements makes them difficult to clean, and it is also difficult to clean the base of the vessel even though this remains visible through the heater. Whilst in the UK and other countries users of electric kettles and hot water jugs have to a degree accepted the unpleasing appearance of the lower region of the vessel interior, in some countries there is a strong reluctance for this reason to use immersion heaters and it is still more common to find the less efficient externally mounted heaters discussed above.

Viewed from one aspect the invention provides an electric immersion heater comprising a support plate which is provided on at least one side thereof with a heating element in the form of a printed circuit conductive track and incorporating a clamping part which is adapted to be clamped in relation to a control device of the type having a thermally sensitive actuator which cooperates with a switch diasabling the heater in the event of it overheating, the clamping part being effective to provide heating for the thermally responsive actuator of the control device.

The support plate should be heat conducting and is preferably formed of metal e.g. stainless steel. It is particularly advantageous, although possibly not essential in all applications, that the heating element is provided on the side of the plate which faces downwardly in normal use of the heater.

An immersion heater in accordance with the invention has a number of advantages compared with known immersion heaters. If mounted horizontally adjacent the base of an electric kettle or hot water jug, for example, the user sees the flat upper surface of the support plate which is aesthetically more appealing and easier to clean than known forms of heating element. If the printed circuit heating element is provided only on the underside of the plate, it is not visible to the user and is protected from damage. A heater in accordance with the invention is more compact than a traditional immersion heater of comparable power. As with known immersion heaters, heat dissipated from both sides of the element is utilised for heating liquid.

Printed circuit heaters are known in other contexts and the form of the printed circuit conductive track which forms the heating element may vary. In one embodiment, the heater is formed by depositing one or more thin glass layers on the surface of a stainless steel support plate, followed by the printed circuit conductive track formed e.g. of palladium silver. Finally, a further layer or layers of glass are deposited over the printed circuit track so that it is insulated from the water. Three layers of glass above and below the track are preferred to ensure water tightness. Such an arrangement can be formed from known printed circuit technology. Stainless steel is preferred because it does not significantly oxidise at the high temperatures—e.g. 950° C. —at which the depositing process is performed. Furthermore, it has a high temperature coefficient of expansion, and therefore on cooling will contract more than the glass layers deposited thereon. The glass is therefore placed in compression rather than tension whereby there is a lesser tendency for it to crack.

It is preferred that the heating element follows a tortuous path and it is also preferred that the heating element terminates in respective contact portions adapted to make electrical connection with an electrical control device for the heater in use. The glass coating is interrupted in the regions of the contact portions so that electrical connection can be made thereto. In a preferred form, the contact portions are provided with a lower resistance coating of e.g. silver so that there is no substantial heating in the region where electrical connection is made thereto. Such portions are therefore analogous to the cold leads of a traditional immersion heater.

The clamping part of the heating element is analogous to the so-called "head" part or mounting plate of known immersion heater assemblies. In such an arrangement, a heater mounted within a vessel may conveniently be clamped in relation to a control device mounted externally to the vessel via an opening in the vessel wall.

Such a combination of heating element and control device is considered to contain inventive matter and therefore, viewed from a second aspect, the invention provides an electric immersion heater and control device arrangement comprising an electric immersion heater having a heating element in the form of a printed circuit conductive track, and a control device having a thermally sensitive actuator which co-operates with a switch for disabling the heater in the event of it overheating, wherein the control device is arranged in relation to the heater such that the thermally sensitive actuator is in thermal contact with part of the heating element of the immersion heaters.

The invention also extends to a water heating apparatus incorporating such a combination and therefore, viewed from a third aspect there is provided an electric water heating apparatus comprising a vessel and an arrangement as previously described, wherein the immersion heater is provided within the vessel and the control device is mounted externally to the vessel, part of the heating elements being in thermal communication with the control device via an opening in the vessel wall.

The clamping part of the heater may be provided with mounting studs or bolts which extend through the vessel wall opening to cooperate with the control device. This is the same as a traditional immersion heater mounting arrangement. A ring shaped seal surrounds the opening in the vessel wall, the heater being clamped against such seal such that the contact portions of the printed circuit element discussed above are located in the "dry" region circumscribed by the seal.

In known immersion heaters it is necessary for the cold leads to extend through the heater head from the wet side to the dry side. This adds to the cost and complexity of the assembly. In accordance with the invention, however, the heating element is substantially flat and may therefore pass under the seal without disturbing it. Thus, in accordance with the invention the printed circuit heating element need not extend through the clamping part of the heater but rather passes between the support plate and the seal.

It is preferred that an immersion heater in accordance with the invention is configured for use with a standard form of control device used in relation to known immersion heaters. In this regard, the contact portions described above are preferably located in relation to the clamping part of the heater in a position similar to the cold leads of a traditional immersion heater. Known control devices are provided with spring contact members configured to make electrical connection with the cold leads when the control device is mounted to the immersion heater head. Such control devices could be modified for use with a heater in accordance with the invention by providing conductive rods to cooperate between the planar contact portions of the heater and the spring contact members of the control device.

As described above, in known immersion heaters there is generally a hot return part of the element which is brazed to the wet side of the heater head and is in thermal contact with a thermally sensitive actuating means of the control device located on the dry side, the actuating means opening a switch and disabling the heater in the event of the element overheating. In accordance with the invention, there is no need for a hot return part of the heating element as such. Rather, since the heating element itself extends to the dry side of the clamping part of the heater where it terminates in contact portions as described above, a region or regions of the element adjacent the contact portions is/are effective to provide the heating for the thermally responsive actuating means of the control device.

In known printed circuit technology it is most convenient to deposit the conductive track at a constant thickness. The width of the track may however be readily varied to vary its resistance. Thus, at any region along the track's length the degree of heating can be reduced by increasing the width of the track and increased by reducing its width. In a preferred embodiment of the invention the width of the track is slightly increased in the region where it passes beneath the seal in use. This is to avoid excess heating of the seal which might damage it.

Safety standards now require for many forms of appliance that there be a backup heater disabling mechanism which is operable in the event that the switch provided in the control device as the primary protector should fail. The backup protector in known controls is generally a one shot device such as a thermal fuse. In accordance with a preferred embodiment of the invention, the printed circuit heating element is provided with one or more higher resistance portions adapted preferentially to rupture and therefore disable the heater in the event of a serious overheat condition consequent upon failure of a primary protector in the control device. As discussed, the region of higher resistance may conveniently be formed by a region of reduced track width. It is preferred that the higher resistance portion or portions is/are provided in the dry region of the heater i.e. the region which in use will be within the seal associated with the vessel wall opening. The reason for this is that if, in extremism, rupturing of the element causes the insulating layer provided thereon to crack then there is still no risk of live parts being exposed to water.

In most known immersion heater configurations the head part of the heater is vertically disposed in use for clamping in relation to a side wall opening of the vessel. Thus, in one form of the invention the heater includes a clamping part extending upwardly in use at about right angles to the main heating part of the heater. The end portions of the heating element extend from beneath the support plate around to the dry side of the clamping part where they terminate in contact portions as described above. The support plate is preferably a unitary member bent into a flattened L-shape when viewed in side elevation.

The embodiment described above requires that the printed circuit track extends around the convex side of the sharp bend in the support plate. This can complicate the printed circuit forming process.

Accordingly, in a further embodiment the support plate is entirely planar and the clamping part is formed approximately centrally in the underside thereof with the heating element substantially surrounding the clamping part in a tortuous and preferably curved path. Such an arrangement is suitable for use in a configuration where the heater is clamped to a control device located beneath the base of a vessel via an opening in the base wall.

BRIEF DESCRIPTION OF THE DRAWINGS

Certain embodiments of the invention will now be described, by way of example only, with reference to the accompanying drawings, wherein.

DESCRIPTION OF THE PREFERRED EMBODIMENTS

Figure 1:
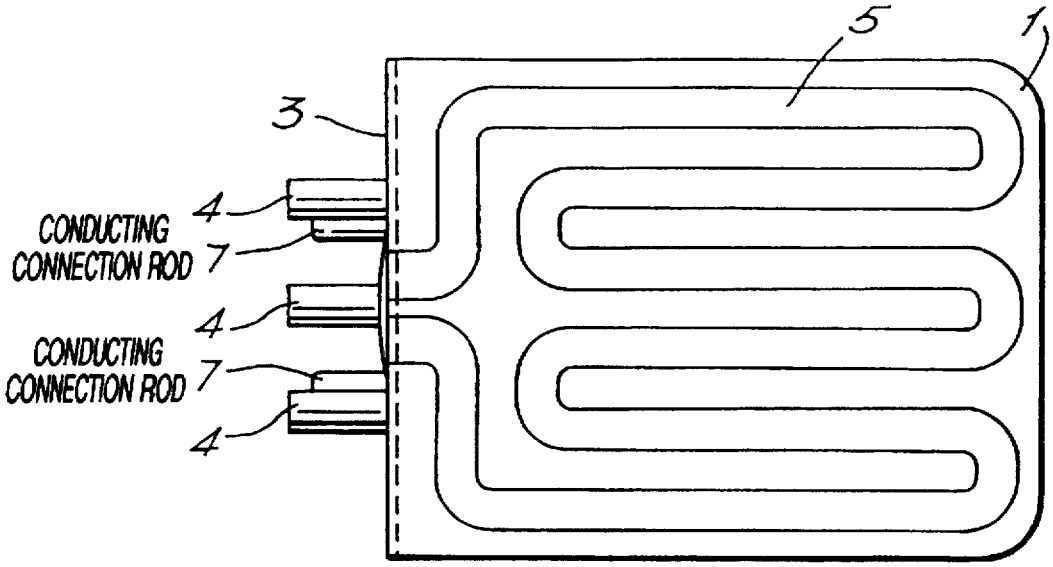
FIG. 1 is an underneath plan view of a first embodiment of immersion heater in accordance with the invention.
Figure 2:
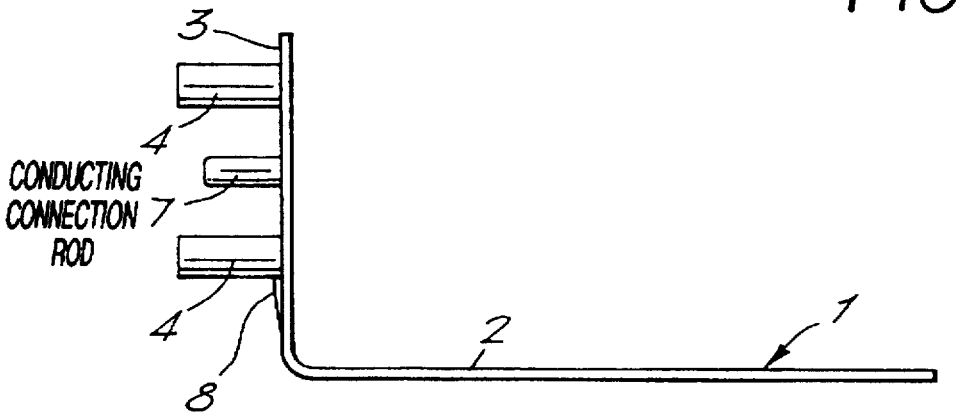
FIG. 2 is a side elevation.

Referring firstly to FIGS. 1 to 5, the immersion heater comprises a stainless steel support plate 1 which is bent into a flattened L-shape configuration as shown in FIG. 2. The support plate therefore comprises a main heating portion 2 and a clamping part 3 which in use may be clamped in relation to a standard form of thermally-sensitive control used with a traditional immersion heater. Examples of such controls are described, for example, in GB-B-2181598 and WO 92/05675. Accordingly, the clamping part 3 is provided with studs 4 which in use extend through an aperture in the wall of an associated heating vessel (not shown) for engagement with the control device. As is traditional, a resilient ring shaped seal (not shown) is associated with the opening such that the central region of the heater clamping part shown in FIG. 3 which confronts the control and which is circumscribed by the seal is kept dry.

Figure 3:
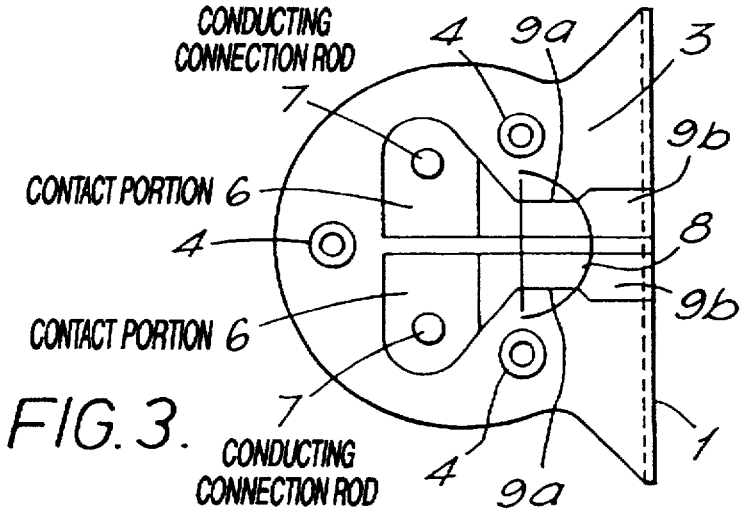
FIG. 3 is an end elevation showing the dry side of the heater clamping part.
Figure 4:
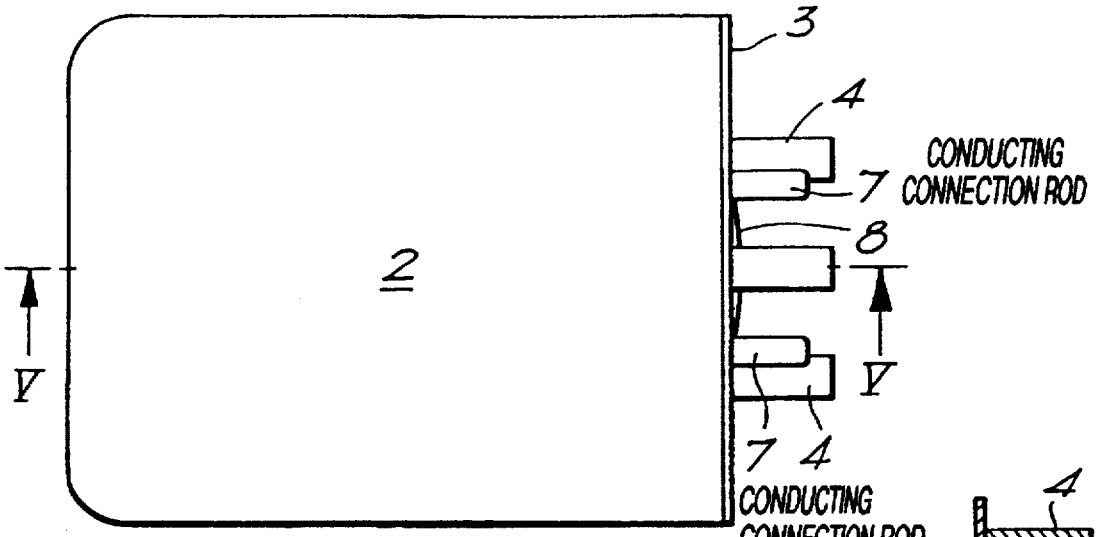
FIG. 4 is a top plan view.
Figure 5:
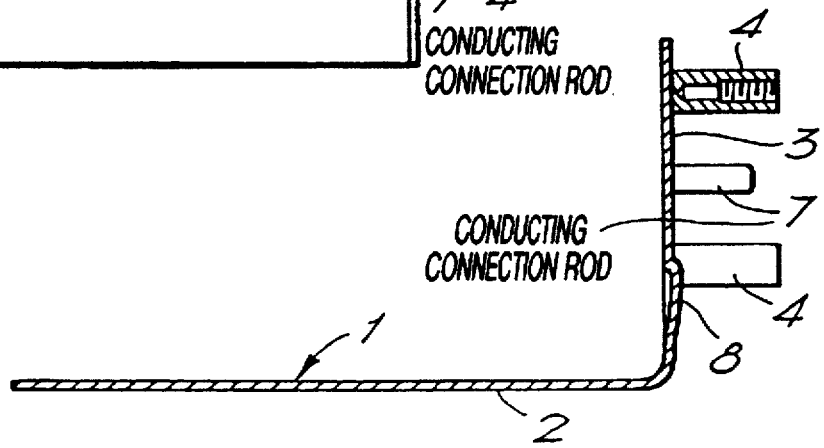
FIG. 5 is a section along line V—V in FIG. 4.

As shown in FIG. 1 the underside of the support plate is provided with a heating element in the form of a printed circuit track 5. The track is deposited between insulating layers of e.g. glass. The end portions of the track extend around the convex side of the bend in the support plate so as to terminate at contact portions 6 as shown in FIG. 3. The glass is removed above the contact portions 6. These contact portions are preferably provided with a coating of low electrical resistance such as silver. This means that there is no substantial heating in the contact portions themselves.

Electrical connection with an associated control device may in use be made between the contact regions 6 and spring connectors in the control device by means of connection rods 7. These rods are separate members which are mounted by being sandwiched between the respective contact surfaces 6 and the control device connectors when the control device is mounted to the clamping part 3 of the heater.

A dimple 8 is formed in the clamping part 3 of the heater adjacent spaced end parts 9*a* of the heating element which extend from the bend in the support plate up to the contact portions 6. Those skilled in the art will recognise such a dimple 8 as a mounting location for a bimetallic actuating means of a standard control device. Thus, in use the actuating means is in good thermal contact with the parts 9*a* of the element and is adapted to open a switch and disable the heater in the event of it overheating in consequence of not being covered by sufficient water.

It will be appreciated that, in accordance with the invention, there is no need for a traditional hot return part and, furthermore, cold leads extending through the element head part are also not required. This is in consequence of the printed circuit element track being able to pass between the seal and the mounting plate without disturbing the efficacy of the seal.

As shown in FIG. 3 the end parts 9*a* of the heating element are of reduced width. As described above, these regions are intended to preferentially rupture in the event of a serious overheat condition consequent upon failure of the bimetallic actuating means or switch means in the control device. Since the parts 9*a* are within the seal they are dry. This provides an extra safety feature in that, should the insulating layer rupture, there is still no risk of live parts being exposed to water. In the first embodiment with its vertical clamping part 3, the parts 9*a* should be level with or preferably below the bimetallic actuating means of the control. Otherwise, there would be a danger of the parts 9*a* rupturing in advance of an operable bimetallic actuating means disabling the heater if a container is filled with water to a level above the actuating means but below the parts 9*a*.

There are also regions 9*b* of increased width of the conductive track at the point where it passes beneath the seal. This provides a region of reduced heating which may be required to avoid damage to the seal.

In the illustrated embodiment, the main track is 5 mm wide, the parts 9*a* are 4½ mm and the parts 9*b* are 6 mm.

Figure 6:
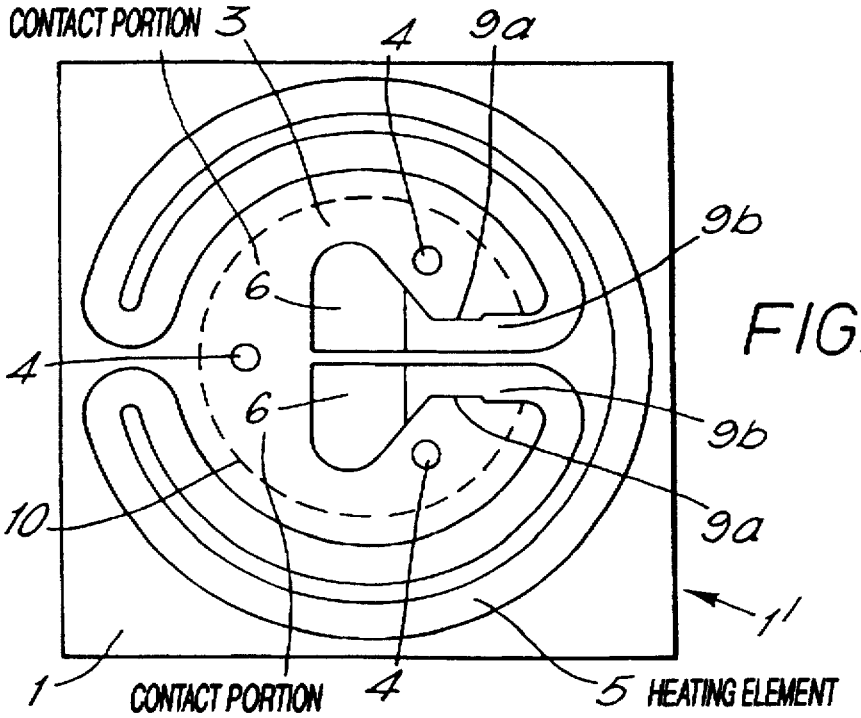
FIG. 6 is an underneath plan view of a second embodiment of heater in accordance with the invention.

A second embodiment of the invention is shown in FIG. 6. In this embodiment, the support plate 1 is completely flat. The clamping part 3 is the central region of the plate. The dry side of the clamping part 3 is in use contained within the broken line 10 which corresponds to the position of the seal in use. The main portion of the heating element 5 surrounds the clamping part. It will be appreciated that this embodiment is intended for use in a vessel wherein the control device for the immersion heater is mounted beneath a base wall of the vessel and the heater is clamped to the control device via an opening in such base wall. Accordingly, mounting studs or bolts 4 project downwardly from the heater through the base wall opening. Otherwise, the features of the heater described above in relation to the first embodiment are similarly provided in the second embodiment and like reference numerals are used. The circular configuration of heater 5 enables a maximum length of heating element track to be provided within a minimum diameter of support plate. A square support plate is illustrated but in practice this would preferably be circular also.

Figure 7:
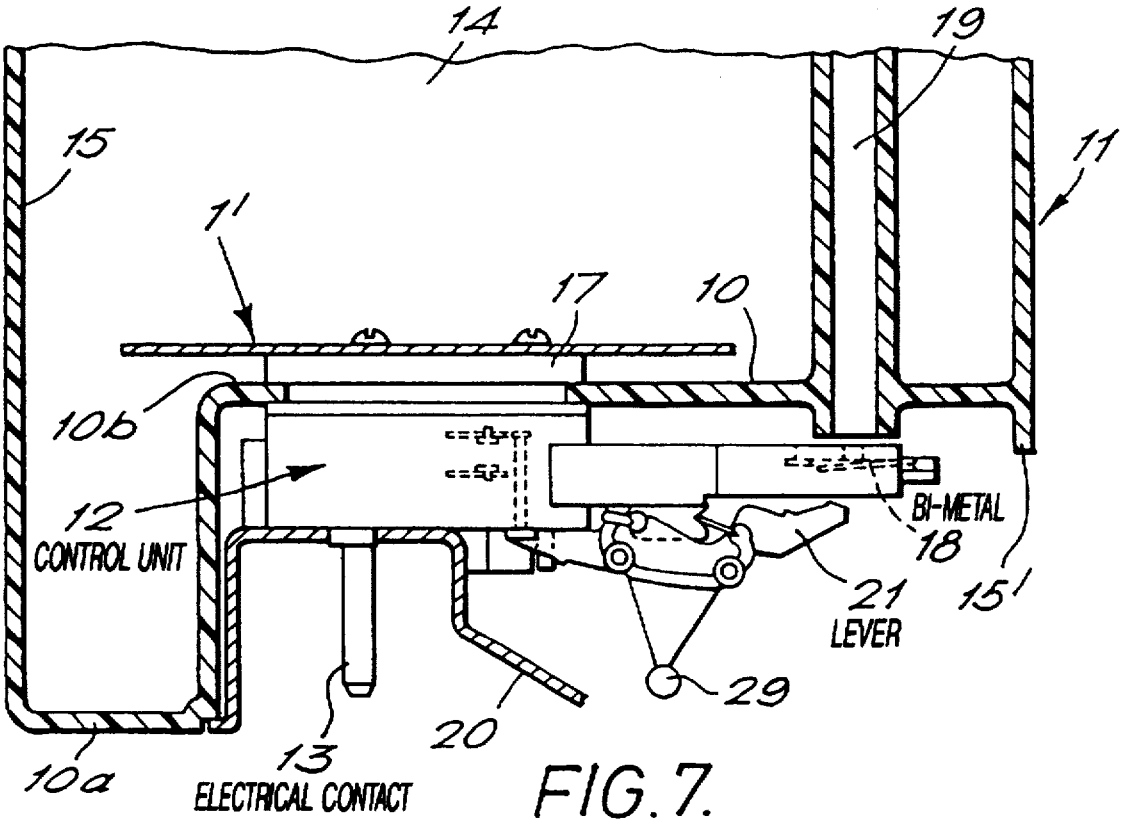
FIG. 7 is a partially sectional view of an electric water heating jug incorporating an immersion heater in accordance with the second embodiment of the invention.
Figure 8:
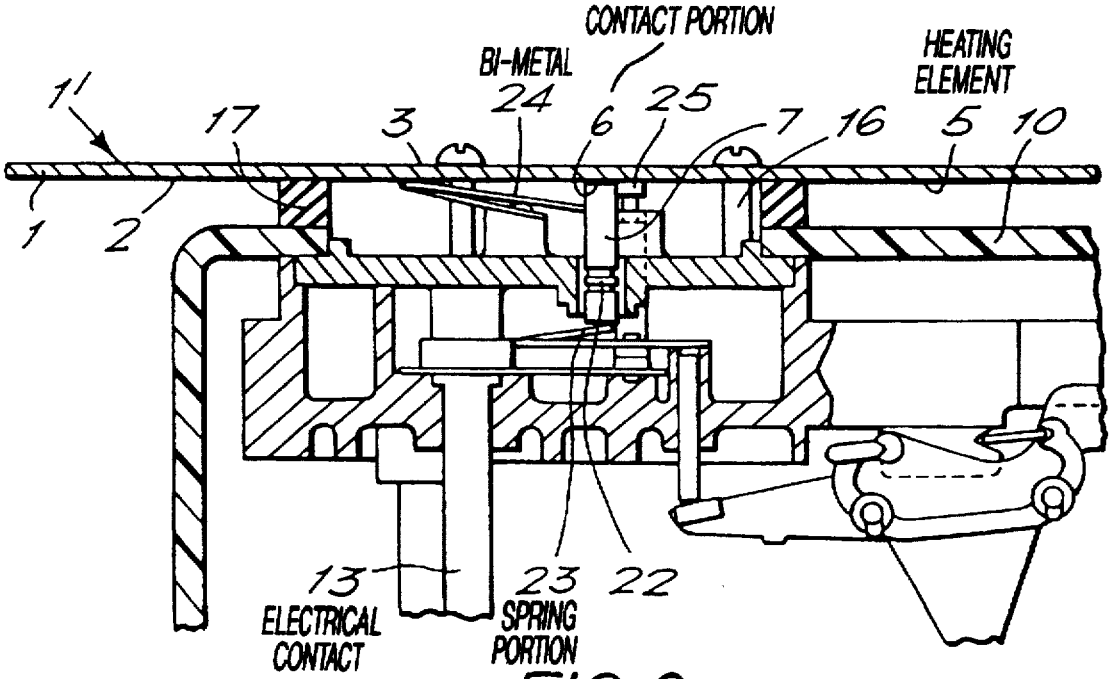
FIG. 8 is an enlarged view of a portion of FIG. 7, showing a control unit in section.

FIGS. 7 and 8 illustrate the heater 1' of the second embodiment mounted through an opening in the base wall 10 of an electric water heating jug 11 to a control unit 12. The jug is of the cordless type and is provided with electrical contacts 13 (which form part of the control unit 12) in a recessed portion of its lower surface. These provide electrical connection to a base unit (not shown).

The cut-away portion at the bottom of the jug may be provided with an operating lever, or alternatively the jug base may be provided with control apparatus as described in GB 2222025. The cut-way upper portion of the jug is of conventional design, and may also be as illustrated in GB 2222025. The jug forms a water receiving portion 14. This is bounded by side wall 15 and base wall 10. The base wall is formed in two portions, one of which 10*a* is level with the bottom of the vessel and the other part 10*b* is raised above the base of the vessel in order to provide a dry chamber in which the control unit 12 is located.

The control unit illustrated is similar to that commercially available as the Strix R32 control and described in detail in GB 2181598. The unit is clamped to heating element 1' as described previously via an opening in the base wall portion 10*b*. In the illustrated apparatus, bolts 16 pass through holes in the heating element 1' and through the mounting holes in the control unit 12 to nuts located in recesses on the far side of the control unit. Alternatively, the element may be provided with studs such as those found on conventional heating elements. A resilient ring shaped seal 17 is provided between the heating element 1' and the base wall 10 in order to provide a water tight seal.

The control unit 12 is provided with a steam operated bi-metal 18 which switches off the kettle when water within it boils. In order for this to operate, a steam channel 19 is provided outside one of the walls of the jug. Its lower end is located adjacent to the steam operated bi-metal and at its upper end, near the top of the jug, an aperture is provided which communicates with the water receiving portion 14. This allows steam produced by water boiling within the vessel to operate the control unit in the conventional manner.

Beneath the control unit a cover 20 is provided which in combination with a lower part of the outer jug body 15', encloses the control unit and forms part of the bottom of the jug. As a lower part of the jug is cut-way, the actual from of the cover is not shown in full. It may be provided with an aperture to receive an actuator mounted in a base unit, or it may receive a conventional control lever which extends from the side of the jug. In the latter case, the lever would be arranged to co-operate with portion 29 of the control unit.

In order to switch on the jug it is necessary to move portion 29 to the right in order to close a set of contacts within the control unit. This also causes the end of lever 21 to engage with the bi-metal 18. Lever 21 is connected by an over center mechanism to the contacts and the arrangement is such that when the steam operated bi-metal 18 reaches a sufficient temperature, lever 21 is moved downwardly sufficiently far to trip the over center mechanism and open the contacts within the control unit 12. The operation of this aspect of the control unit is known in the art and will therefore not be described further.

FIG. 8 illustrates the inter-relationship between the heating element 1' and the thermal, electrical and mechanical connections of the control unit 12. The electrical connection is achieved by providing conducting connection rods 7 in the apertures in the control unit 22 in which the cold tails of a conventional immersion heater are normally received. These are biased upwardly by the spring contacts 23 within the control unit against the contact portions 6 of the heating element 1'.

Mechanical connection, as discussed above, is made by passing studs or bolts 16 from the heating element 1' through the holes in the control unit in a manner similar to that employed with traditional elements. As the heating element is clamped to the control unit, it compresses resilient seal 17, thereby closing the aperture in the base of the jug in a water-tight manner. The holes through which the bolts are mounted may be sealed by providing resilient washers under the heads of the bolts.

Thermal connection to the control unit is necessary in order to allow the over-heat protection systems in the unit to operate. The control unit is provided with a snap acting bi-metal 24 which, in a conventional jug, is held in thermal contact with the hot return portion of a conventional element. In the present case it is held directly against the bottom of the heating element 1'. In order to ensure a good thermal connection, it may be necessary to bend the bi-metal upwardly slightly from its usual position, to provide a convex portion on the heating element, and/or to apply a small quantity or heat sink compound.

The snap acting bi-metal 24 is connected to a set of electrical contacts within the control unit and its purpose is to disconnect the supply of electrical current from the heating element 1' in the event that the element overheats, for example as result of having being switched on dry. As a further level of protection, a one-shot cut out device is provided in the control unit which will permanently disable the control unit in the event that the previously described over heat protection system out fails to operate. This is in the form of a plastics pin 25 which is biased against the bottom of support plate 11 by a spring within the control unit. The action of clamping the element to the control unit presses the pin against the spring and this holds closed a set of contacts within the control unit. In the event of serious overheating, the pin 25 will melt, thereby allowing the contacts to open. The control unit must then be replaced.

It will be apparent to a person skilled in the art that in this embodiment of the heater element allows control unit 12 to operate in an entirely conventional manner. Thus the steam control, the overheat protection system and the one-shot overheat protection device will function as if they were connected to the head of a conventional immersion heater.

Figure 9:
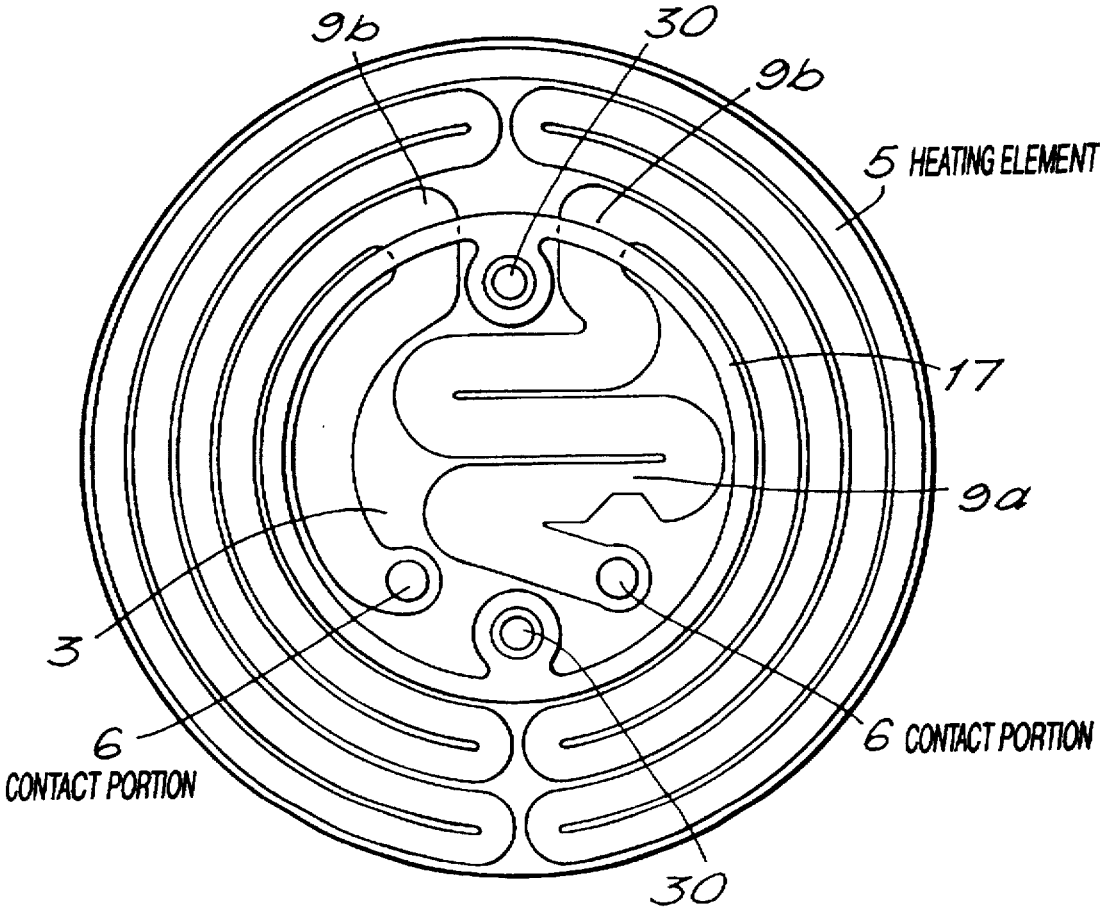
FIG. 9 is a plan view of an immersion heater according to a third embodiment of the invention.

FIG. 9 illustrates a still further version of the heating element. It is substantially similar to the heating element of the second embodiment, except that it is designed for operation in combination with a control unit which requires only two mounting bolts or studs. The mounting holes 30 are arranged such that a portion of the resilient seal may pass around bolts or studs securing the heating element to a control in use, and thereby preventing leakage of water around the bolts or studs. Thus, no further sealing means such as resilient washers are necessary. The remaining parts of the element correspond to the second embodiment and reference numerals correspond to those used in respect of that embodiment.

Whilst the illustrated embodiments have a main track width of 5 mm, this may of course be varied, depending on the volumetric resistivity and thickness of the conductive track material. For example it has been found possible to produce a track having a width of 2½ mm in its main part, and 2 mm and 3 mm respectively in the regions **9*a* and 9*b*** described above. This is advantageous as it allows the plate to be smaller, resulting in a more compact construction, as well as giving a saving in plate material costs.

It is also envisaged that the one shot, further level protection device provided in the known control device (i.e. the meltable pin 25 in FIG. 8) may be omitted in view of the back-up protection provided by the preferentially rupturable regions **9*a*** of the heating element.

I claim:

1. An electric immersion heater comprising:

a support plate;

a heating element provided on at least one side of the support plate, the heating element being in the form of a printed circuit conductive track;

a control device, the control device having a thermally responsive actuator;

a switch, the thermally responsive actuator cooperating with the switch to disable the heating element when a temperature of the heating element exceeds a predetermined temperature; and the heating element having a localized region to which the control device is clamped by a clamping part, the region further comprising electrical contact portions arranged to make electrical connection to the control device when the control device is clamped to the region, the region being in thermal contact with the thermally responsive actuator.

2. An electric immersion heater as claimed in claim 1, wherein the support plate is formed of metal.

3. An electric immersion heater as claimed in claim 1, wherein the heating element is provided on a bottom side of the support plate.

4. An electric immersion heater as claimed in claim 3, wherein the contact portions have a coating with a lower resistance than other portions of the region.

5. An electric immersion heater as claimed in claim 1, wherein the heating element is substantially flat.

6. An electric immersion heater as claimed in claim 1, wherein the region of the heating element is provided with mounting studs or bolts that connect the control device to the region.

7. An electric immersion heater as claimed in claim 6, wherein the region in thermal contact with the thermally responsive actuator is located between the mounting studs or bolts.

8. An electric immersion heater as claimed in claim 1, wherein the width of the track is increased in where the track passes beneath a control device seal relative to other portions of the track.

9. An electric immersion heater comprising:

a support plate;

a heating element provided on at least one side of the support plate, the heating element being in the form of a printed circuit conductive track;

a control device, the control device having a thermally responsive actuator;

a switch, the thermally responsive actuator cooperating with the switch to disable the heating element when a temperature of the heating element exceeds a predetermined temperature; and the heating element having a localized region to which the control device is clamped by a clamping part, the region further comprising electrical contact portions arranged to make electrical connection to the control device when the control device is clamped to the region, the region being in thermal contact with the thermally responsive actuator, wherein the heating element is provided with one or more resistance portions that have, as compared to other portions of the heating element, a greater tendency to rupture to thereby disable the heating element.

10. An electric immersion heater as claimed in claim 9, wherein the one or more resistance portions are provided in the region of the heating element within a control device seal.

11. An electric immersion heater comprising:

a support plate;

a heating element provided on at least one side of the support plate, the heating element being in the form of a printed circuit conductive track;

a control device, the control device having a thermally responsive actuator;

a switch, the thermally responsive actuator cooperating with the switch to disable the heater when a temperature of the heating element exceeds a predetermined temperature; and the heating element having a localized region to which the control device is clamped by a clamping part, the region further comprising electrical contact portions arranged to make electrical connection to the control device when the control device is clamped to the region, the region being in thermal contact with the thermally responsive actuator, wherein the clamping part extends at substantially a right angle to a main heating part of the heating element.

12. An electric immersion heater comprising:

a support plate;

a heating element provided on at least one side of the support plate, the heating element being in the form of a printed circuit conductive track;

a control device, the control device having a thermally responsive actuator;

a switch, the thermally responsive actuator cooperating with the switch to disable the heating element when a temperature of the heating element exceeds a predetermined temperature; and the heating element having a localized region to which the control device is clamped by a clamping part, the region further comprising electrical contact portions arranged to make electrical connection to the control device when the control device is clamped to the region, the region being in thermal contact with the thermally responsive actuator, wherein the support plate is entirely planar and the clamping part is formed approximately centrally in an underside of the support plate with the heating element substantially surrounding the clamping part in a tortuous path.

13. An electric immersion heater and control unit arrangement comprising:

an electric immersion heater, the immersion heater having a heating element, the heating element being in the form of a printed circuit conductive track, and a control device, the control device having a thermally responsive actuator, and a switch, the thermally responsive actuator cooperating with the switch to disable the heating element when a temperature of the heating element exceeds a predetermined temperature, wherein the control device is mounted to the immersion heater such that the control device is brought into electrical connection with the heating element, and the thermally sensitive actuator is brought into thermal contact with part of the heating element.

14. An arrangement as claimed in claim 13, wherein the immersion heater further includes a support plate, the heating element being provided on at least one side of the support plate, and the heating element having a localized region to which the control device is clamped by a clamping part, the region further comprising electrical contact portions arranged to make electrical connection to the control device when the control device is clamped to the region, the region being in thermal contact with the thermally responsive actuator.

15. An arrangement as claimed in claim 13, wherein the immersion heater has electrical contact portions and the control unit is provided with spring contact members connected to the electrical contact portions of the heating element.

16. An arrangement as set forth in claim 13, further comprising a vessel for receiving water, the vessel including a wall, wherein the immersion heater is provided within the vessel and the control device is mounted externally to the vessel, the part of the heating element being in thermal contact with the thermally responsive actuator via an opening in the wall of the vessel.

17. An electric water heating apparatus as claimed in claim 16, wherein the vessel includes a base, and the control device is located beneath the base of the vessel and the heater is clamped to the control device through the opening.

18. An arrangement as claimed in claim 16, further comprising conductive rods to connect electrical contact portions of the heater and spring contact members of the control device.

19. An arrangement as claimed in claim 13, wherein the control device further comprises a one-shot cut-out device.

20. An electric liquid heating apparatus comprising:

a liquid heating vessel having an opening in a base thereof;

an electric heater mounted to close the opening, the heater having a liquid heating surface disposed inside the vessel, the heater including a support plate having on its underside an electrically insulating layer on which is provided a heating element in the form of a printed circuit conductive track terminating in electrical contact portions;

a thermally sensitive control arranged under and clamped against the underside of the plate, the thermally sensitive control having a thermally sensitive actuator;

a switch, the thermally sensitive actuator cooperating with the switch to disable the heater when the heater reaches a predetermined temperature, the thermally responsive actuator being clamped against and in thermal contact with a portion of the conductive track; and electrical contacts for supplying electrical energy to the heating element, the contacts being resiliently biased against the contact portions of the heating elements.

* * * * *